US009464772B2

(12) United States Patent
O'Brien et al.

(10) Patent No.: US 9,464,772 B2
(45) Date of Patent: Oct. 11, 2016

(54) AMBIENT DIRECTIONAL COMBINATION LIGHT FIXTURE

(71) Applicant: CORDELIA LIGHTING INC., Rancho Dominguez, CA (US)

(72) Inventors: Aaron O'Brien, Los Alamitos, CA (US); Huan C. Nguyen, Anaheim, CA (US)

(73) Assignee: CORDELIA LIGHTING INC., Rancho Dominguez, CA (US)

( * ) Notice: Subject to any disclaimer, the term of this patent is extended or adjusted under 35 U.S.C. 154(b) by 106 days.

(21) Appl. No.: 14/596,202

(22) Filed: Jan. 13, 2015

(65) Prior Publication Data

US 2015/0198311 A1 Jul. 16, 2015

Related U.S. Application Data

(60) Provisional application No. 61/926,932, filed on Jan. 13, 2014.

(51) Int. Cl.

| | |
|---|---|
| ***F21S 4/00*** | (2016.01) |
| ***F21V 21/005*** | (2006.01) |
| ***F21V 23/06*** | (2006.01) |
| ***F21S 8/06*** | (2006.01) |
| ***F21S 8/04*** | (2006.01) |
| *F21V 21/35* | (2006.01) |
| *F21V 21/30* | (2006.01) |
| *F21V 23/00* | (2015.01) |
| *F21V 23/04* | (2006.01) |
| *F21Y 101/02* | (2006.01) |

(52) U.S. Cl.

CPC ..... *F21S 8/066* (2013.01); *F21S 8/046* (2013.01); *F21V 21/30* (2013.01); *F21V 21/35* (2013.01); *F21V 23/003* (2013.01); *F21V 23/0435* (2013.01); *F21Y 2101/02* (2013.01)

(58) Field of Classification Search

CPC ..... F21S 8/046; F21S 8/066; F21S 4/008; F21V 21/30; F21V 21/34; F21V 21/35; F21V 23/003; F21V 23/004; F21V 23/0435; F21V 23/06; F21V 13/04; F21V 19/02; F21Y 2101/02; F21Y 2103/003

See application file for complete search history.

(56) References Cited

U.S. PATENT DOCUMENTS

| | | | | |
|---|---|---|---|---|
| 4,688,154 A * | 8/1987 | Nilssen | F21V 21/35 | 307/157 |
| 7,172,332 B2 * | 2/2007 | Mobarak | H01R 25/142 | 362/147 |
| 7,665,862 B2 * | 2/2010 | Villard | F21V 14/02 | 362/249.02 |

(Continued)

OTHER PUBLICATIONS

Aaron O'Brien, Disclosure From Inventor Aaron O'Brien Re State of Art Jan. 2014, Jan. 2014, pp. 1-3.

*Primary Examiner* — Alan Cariaso
(74) *Attorney, Agent, or Firm* — Paul Y. Feng; One LLP

(57) ABSTRACT

A lighting system having a general light source and directional light sources disposed on a light bar pendant, mounted, or extending from the general light source. The general light source is flush mounted to the ceiling and includes an array of LEDs, powered by an LED driver, all enclosed in a canopy having a light-transmitting lens, and one or more directional light sources containing LEDs are adjustably, and movably mounted to the light bar. Electrical conductor paths on or within the light bar connect the directional light sources to the main power supply or LED driver.

18 Claims, 23 Drawing Sheets

(56) References Cited

U.S. PATENT DOCUMENTS 8,348,492 B2 1/2013 Mier-Langner et al.
2004/0051466 A1* 3/2004 Liu ..... H02J 9/02 315/149
2005/0243549 A1* 11/2005 Ruston ..... F21S 2/00 362/233
2014/0063794 A1* 3/2014 Parekh ..... F21S 8/04 362/185

* cited by examiner

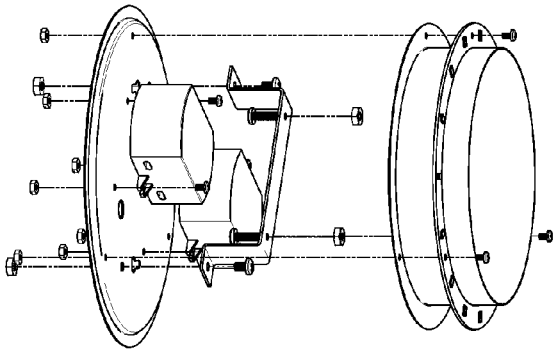
FIG.17
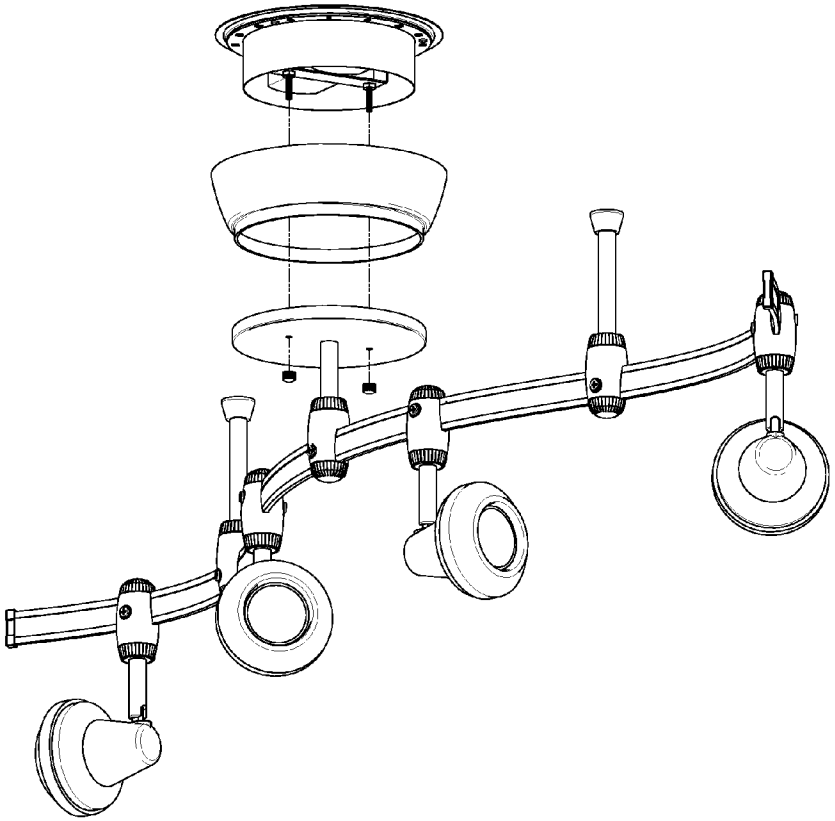

AMBIENT DIRECTIONAL COMBINATION LIGHT FIXTURE

CROSS-REFERENCE TO RELATED APPLICATIONS

This application claims benefit of priority to provisional application No. 61/926,932, filed Jan. 13, 2014, the contents of which are hereby incorporated by reference.

FIELD OF THE INVENTION

The present invention relates to lighting fixtures. In particular, the present invention relates to track light fixtures and related light fixtures that are directionally adjustable.

BACKGROUND OF THE INVENTION

Track lighting is a style of decorative lighting found in homes and commercial establishments. Each track light fixture is slidably attached on a straight, metal bar that contains electrical conductors. The bar/track is mounted to the ceiling, wall, ceiling joists, etc. The track provides electrical power to the individual light fixtures mounted to it, so there is no need to route electrical wiring to the individual lights. The individual light fixtures are adjustable as to their locations via the track, and the individual light fixtures further swivel and are adjustable as to the angle at which the light is directed. Hence, track lighting is popular for accent lighting, task lighting, spot lighting, mood lighting along a wall, etc.

Track lighting systems have a line voltage running along the track, so typically, all lights on the track operate in unison. On the other hand, the track may have more than one live conductor so that multiple switched circuits can be used to control different light fixtures mounted on the same track.

Common in the North American market are three standard types of tracks. These standard types are known as "H," "J," and "L" track, named after the manufacturers that established the standards, Halo, Juno, and Lightolier, respectively. Other styles of tracks are also available.

More modern systems offer low voltages running through the track. With such a system, the light fixture has conductors that clamp onto a track made of two powered metal strips separated with an insulating strip. The track is powered by a transformer that converts the high voltage of the power supply into the low voltage used by the light fixtures.

SUMMARY OF THE INVENTION

The present invention in various preferred embodiments is directed to a track lighting system electrically wired to a junction box and installed to a mounting surface such as a ceiling or like building framework, the track lighting system comprising a general light source such as a LED driver, a printed circuit board, one or more LEDs mounted thereon, an optional light reflector preferably disposed at about the center of the array of LEDs, and an electrical connector. A canopy at least partially covers or encloses the LED driver, printed circuit board, the LEDs, the reflector, and the electrical connector, wherein the canopy includes a light transmitting lens for emitting the LED light. The electrical connector, the LED driver and LEDs, printed circuit board, and electrical connector are electrically wired to the junction box.

The system further includes a directional light source extending from the general light source, further including a light bar disposed on the general light source, at least one secondary light source, a housing at least partially enclosing the secondary light source and having a position on the light bar and aimed or oriented in a selectable direction, wherein the housing is adjustable relative to the light bar for position and directional aim of the light source. Electrical conductors disposed on or within the light bar electrically connect the secondary light source to the electrical connector of the general light source.

The secondary light source may be an incandescent bulb, halogen bulb, LED bulb or LED die or array, neon bulb, CFL, or fluorescent tube. The electrical connector is preferably a quick connect. The secondary light source when selected as an LED emitter or array can be wired to the LED driver from the general light source. Thus, multiple LED drivers are unnecessary, even though the system in one embodiment might have several directional LED-powered directional light sources. Accordingly, the general light source having a distribution of light greater than about 300 degrees about a vertical axis, and greater than about 65 degrees from nadir off of the vertical axis.

BRIEF DESCRIPTION OF THE DRAWINGS

FIGS. 16-17 show in various views a fifth embodiment LED track light with a self-illuminated canopy, where the track bar is suspended from the canopy. The track bar has a serpentine shape but other shapes are contemplated. The individual track lights are slidable along the track bar, and their light projection can be directionally adjusted. A ring of LEDs is positioned around the periphery of the canopy with a cylindrical reflector at the center, while a translucent or transparent lens forms a 360 degree wall around the sides of the canopy.

DETAILED DESCRIPTION OF THE PREFERRED EMBODIMENTS

Figure 1:
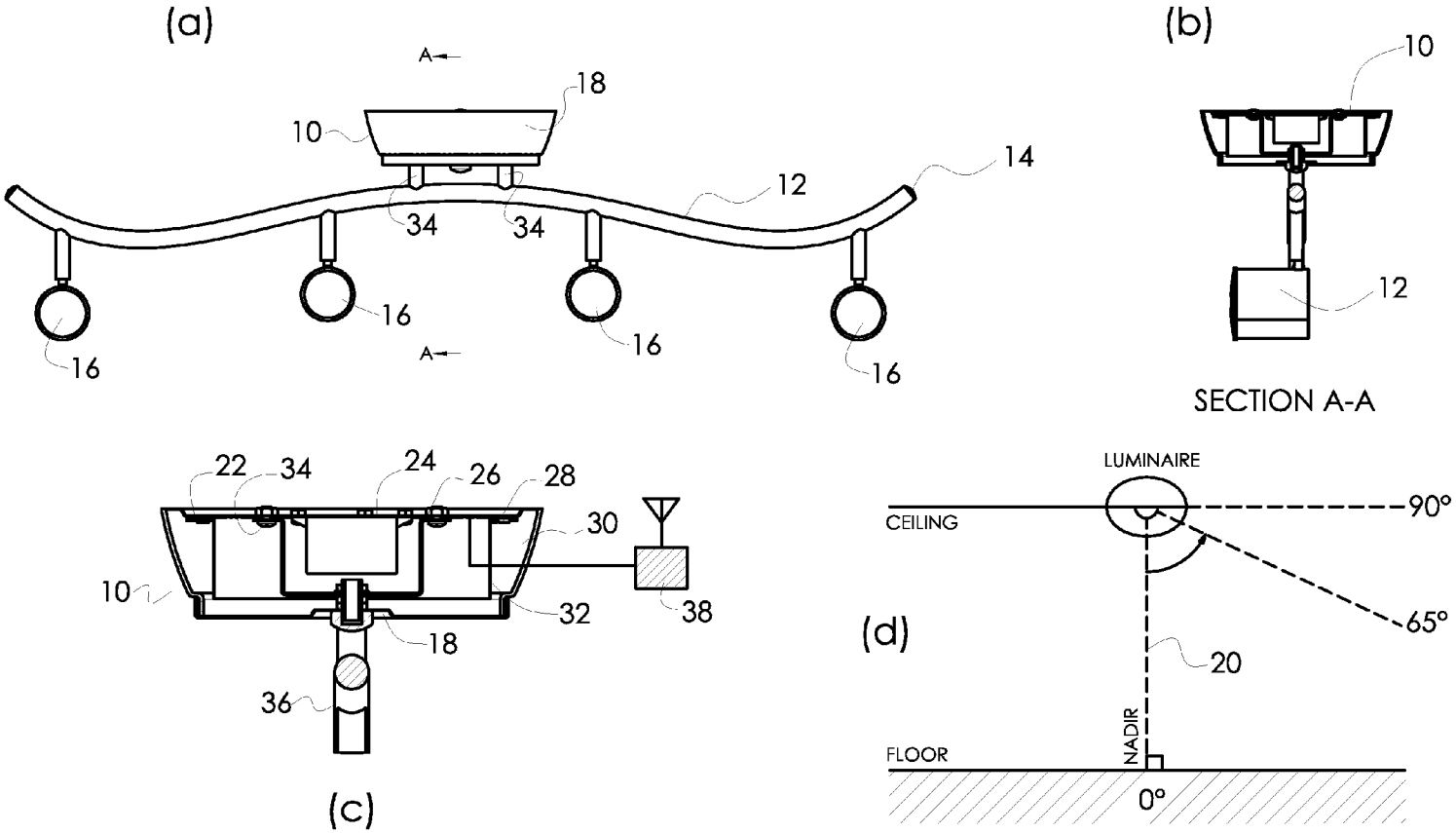
FIGS. 1-2 in various views show a first embodiment of the present invention LED track light for directional lighting with a lighted canopy for general lighting. Cross-sectional view A-A shows the interior of the canopy with a cylindrical reflector, a ring of LEDs mounted on the periphery of a flat plate, a lens surrounding the entire structure, and a canopy at the bottom. Electrical power is wired from the canopy and passed to the serpentine-shaped track where it is conducted to the individual track lights. The track lights may be LEDs, halogen, incandescent, fluorescent, neon, etc.

In existing homes and new construction, a decision is made by an architect or designer to light a room with a specific light source for a given effect or task. This design will then determine how many junction boxes are installed within the specific applications to supply electrical power. A residential kitchen is a good example. A kitchen may be wired with a single junction box on the ceiling to allow the installation of one fixture to provide general lighting to the room. That junction box could also support a track lighting array to provide task lighting in the kitchen. If there is only one junction box, the inevitable choice must be made between a general light fixture or a directional system such as track lighting or a light bar. If the directional fixture is chosen, the areas behind the fixture are dark, but if the general lighting fixture is chosen, there may not be enough light intensity for task lighting such as to read recipes or a cookbook, or to indulge in detailed craftwork or hobbies.

The present invention in preferred embodiments combines both a general light source and directional light sources into one fixture, using only the physical space needed for the directional sources. More precisely, the preferred embodiments contemplate a ceiling light combined with a track light, employing light emitters such as LED, halogen, incandescent, CFL, fluorescent, neon, or any combination thereof. There is no sacrifice in height to combine the two sources. Since this is a single fixture and no additional wiring would be required, it can be easily installed by the homeowner. The homeowner could choose on demand between the two sources or both as desired.

Conventional light fixtures using light sources such as incandescent, halogen, CFL, or fluorescent require a larger fixture encroaching farther down into the residential living space. In a residence with a typical eight-foot high ceiling, this fixture type would be located nearly 12 inches over a resident's head. This would be uncomfortable and look odd to most consumers. Thermal requirements of conventional fixtures also necessitate a larger fixture design to maintain life ratings and pass UL requirements. Conventional light sources also use substantially higher power to create the same ambient light generated by the present invention combination fixture.

For example, most conventional fixtures would require two 60-watt lamps to meet the lumen output requirement for a general lighting fixture. That design also requires a minimum size to maintain the UL temperatures necessary to prevent overheating of the supply wires bringing power into the fixture.

On the other hand, the general light source in the present invention preferred embodiments uses one or more Light Emitting Diodes (LEDs) which adds only a small amount of energy to the overall consumption while staying cool enough to prevent supply wires from being overheated. The low power and lack of radiated heat from the lamps also keep electrical components such as an LED driver from becoming overheated. By controlling heat, this also allows for a low profile design. This makes it possible to convert a canopy designed for wiring to become a functional light fixture.

Using energy efficient sources, such as LEDs for the directional light, further reduces the thermal profile and increases the amount of power available on the circuit to operate additional products. The present invention fixtures may include LEDs or halogen directional fixtures to satisfy specific needs for a given application. Halogen light sources provide tight beam control, and high intensity in a small package size, which is difficult for current LED packages, but the next generation LEDs will replace halogen light sources in a competitive form factor. The present invention contemplates uses of all such light sources, including LEDs, halogen, fluorescent/CFL, incandescent, neon, etc.

FIGS. 1-23 of the attached drawings show various preferred embodiments. One preferred embodiment, such as FIG. 1(*a*), shows a general light source 10 and a directional light source 12 mounted to the general light source 10. The general light source 10 is usually mounted to a ceiling or like building structure above it (not shown). At the ceiling level is also a standard electrical junction box as is known in the art (not shown). The general light source includes an enclosure or canopy 18. As part of the directional light source 12 is a light bar 14 with multiple adjustable heads 16 beneath the canopy 18 which has been converted to a flush mount fixture with an enclosure inside for power connections, as seen in FIG. 1(*c*).

As seen in FIG. 1(*d*), the light distribution for a luminaire such as the present invention starts at the ceiling and illuminates 90+ degrees down to the floor from the ceiling. For a preferred embodiment of the present invention, the general light source has a distribution of light greater than about 300 degrees (i.e., illuminated area on the floor) about a vertical axis 20, and greater than 65 degrees from nadir off of the vertical axis 20 (i.e., elevational azimuth) as depicted in FIG. 1(*d*). This type of light distribution is not achievable with conventional track lighting.

Figure 2:
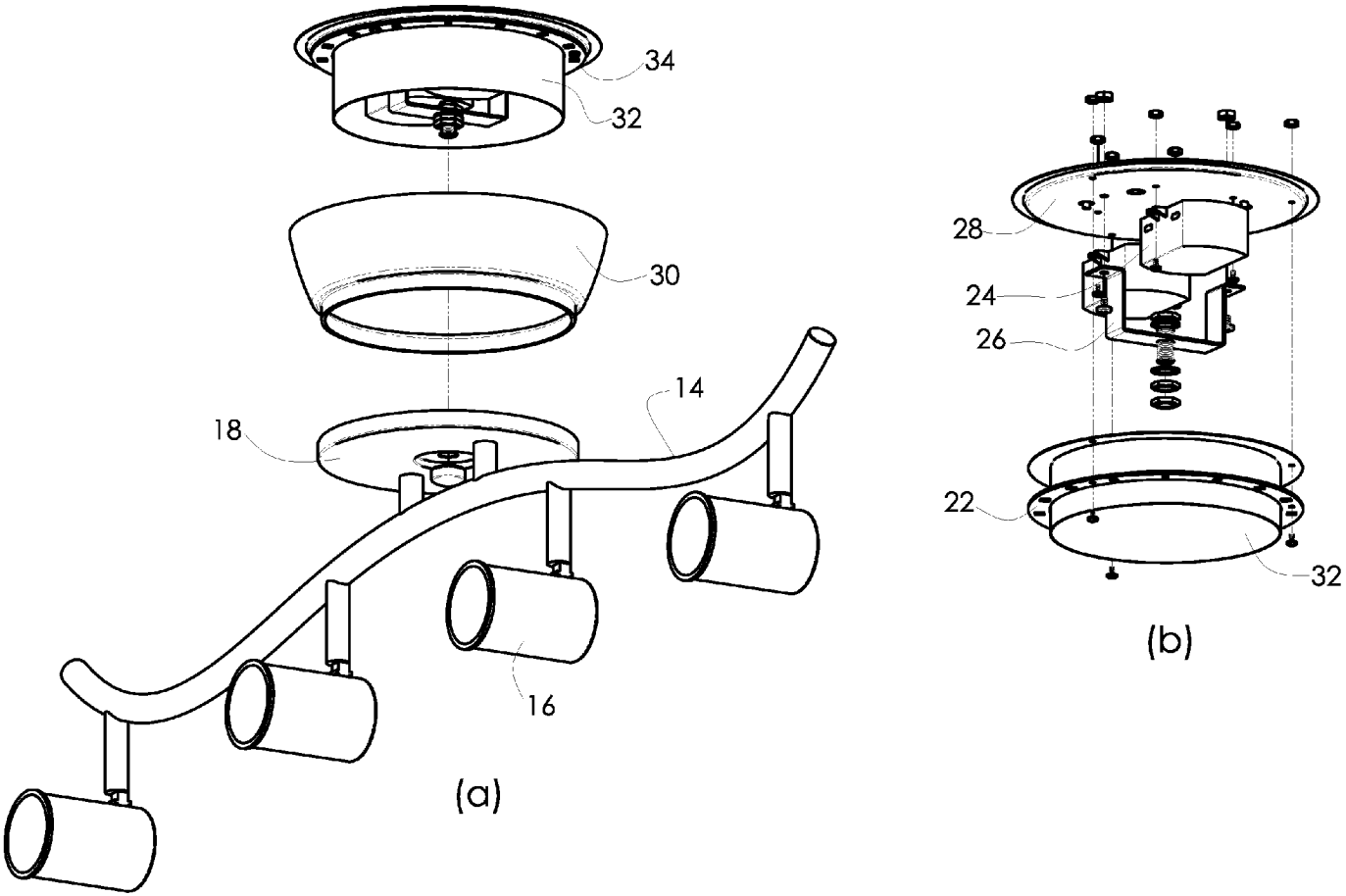
Figure 3:
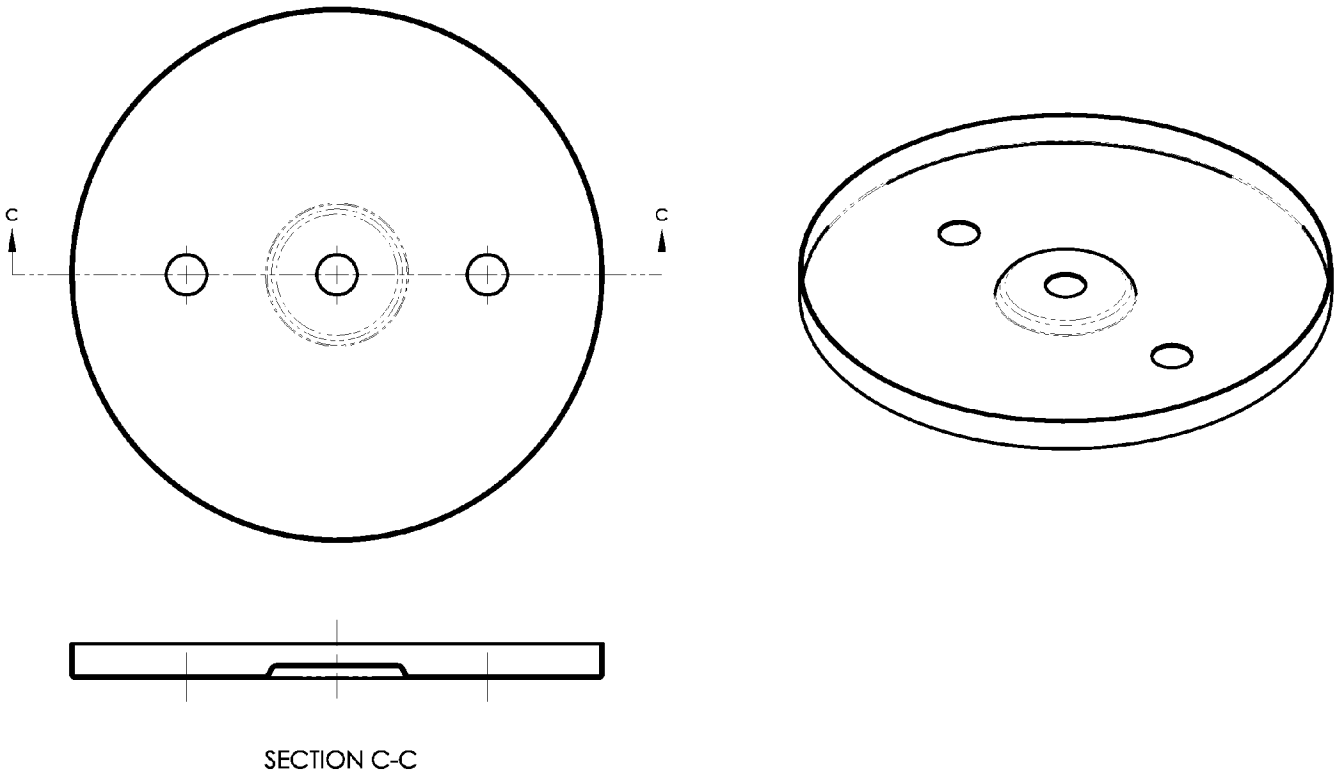
FIG. 3 shows the canopy used in the embodiment from FIGS. 1-2 may be made from metal, plastic, ceramic, glass, and may be translucent or opaque.
Figure 4:
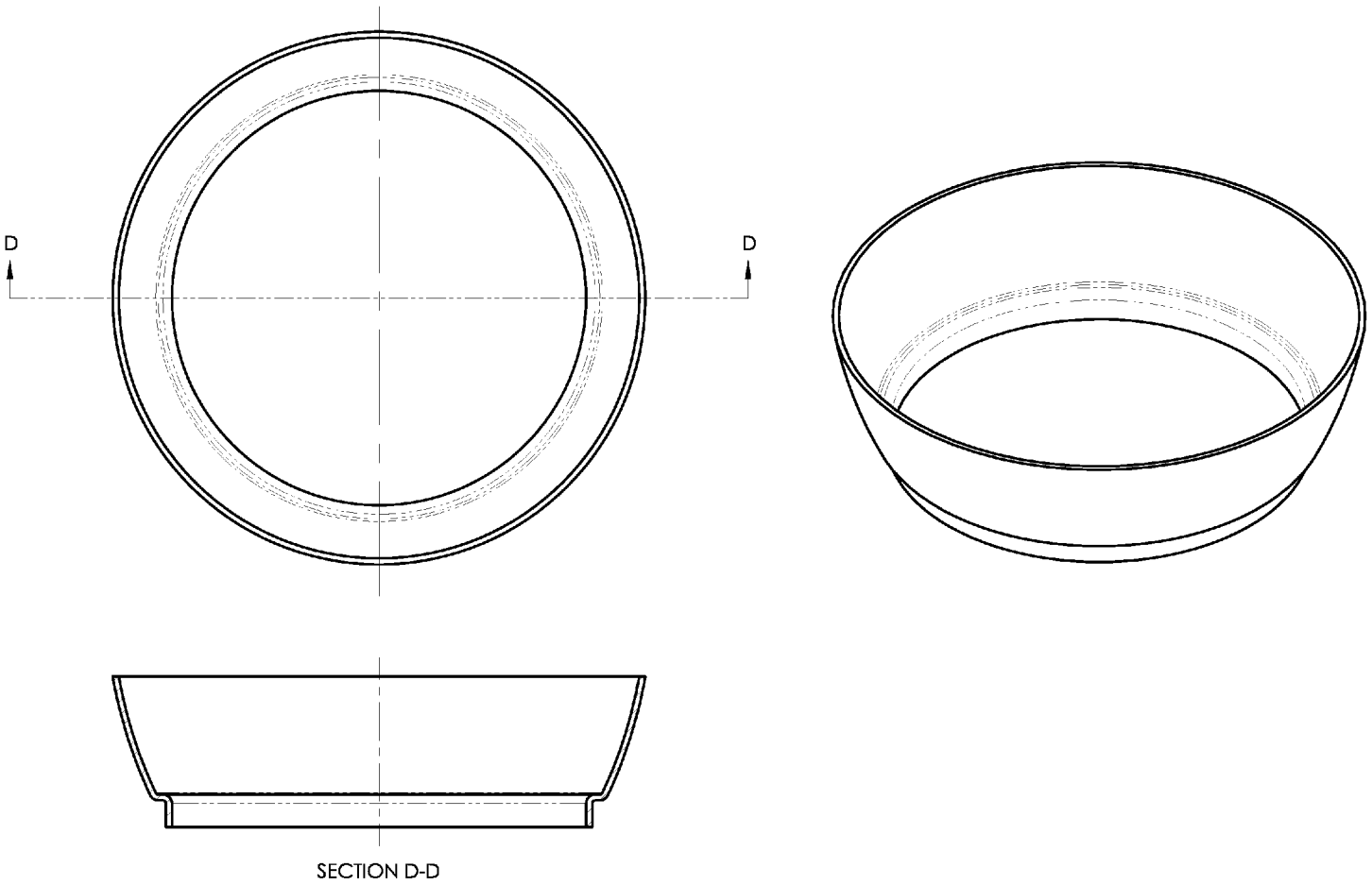
FIG. 4 shows the lens used in the embodiment from FIGS. 1-2 has preferably sloped walls around its circumference, may be transparent or translucent, to provide general lighting and to emit and diffuse light laterally.
Figure 5:
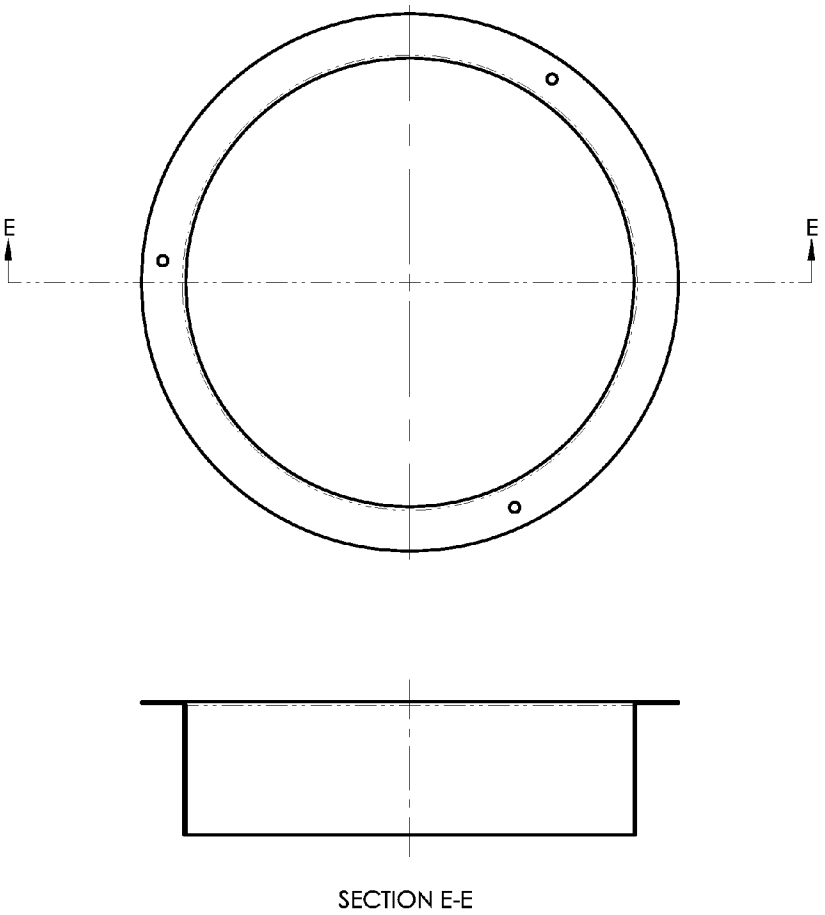
FIG. 5 shows the light reflector used in the embodiment from FIGS. 1-2 that reflect light from the LEDs.
Figure 6:
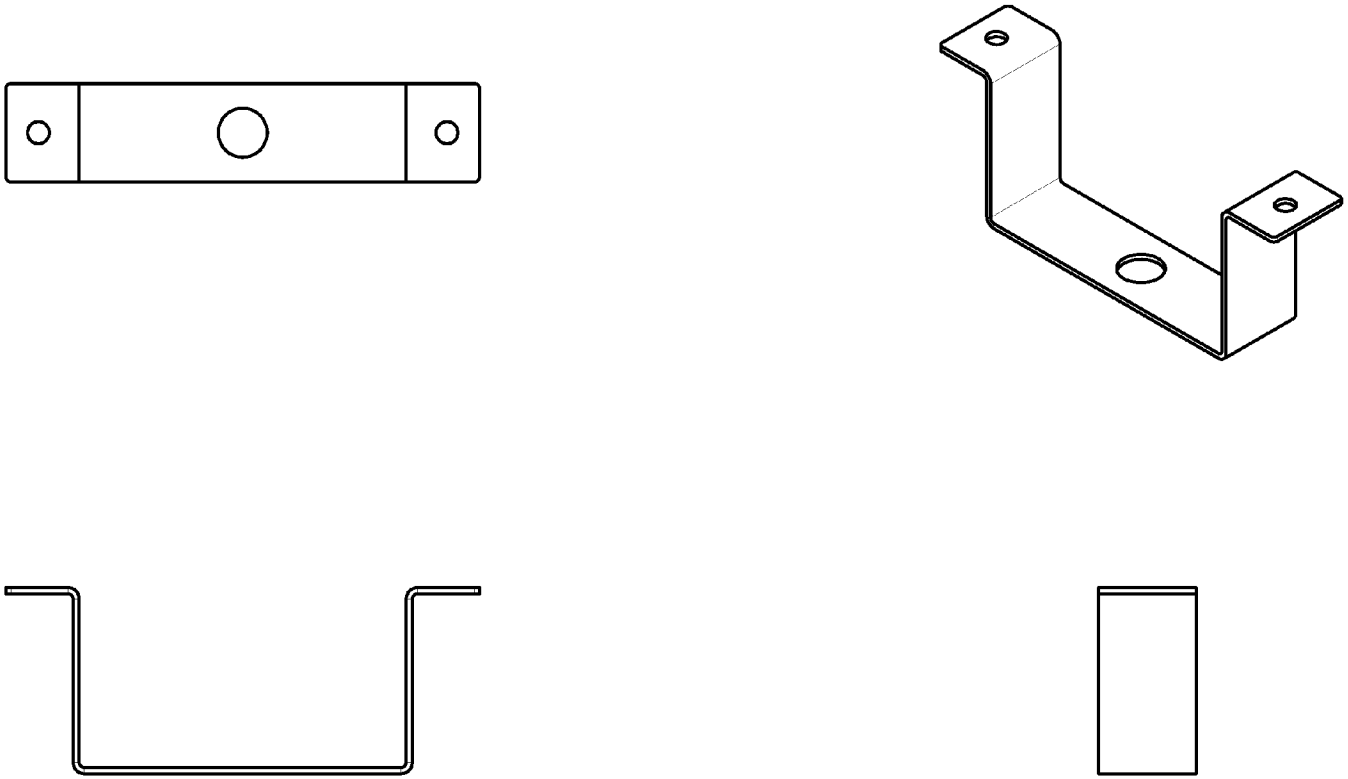
FIG. 6 shows the canopy bracket used in the embodiment from FIGS. 1-2 to support the internal hardware.
Figure 7:
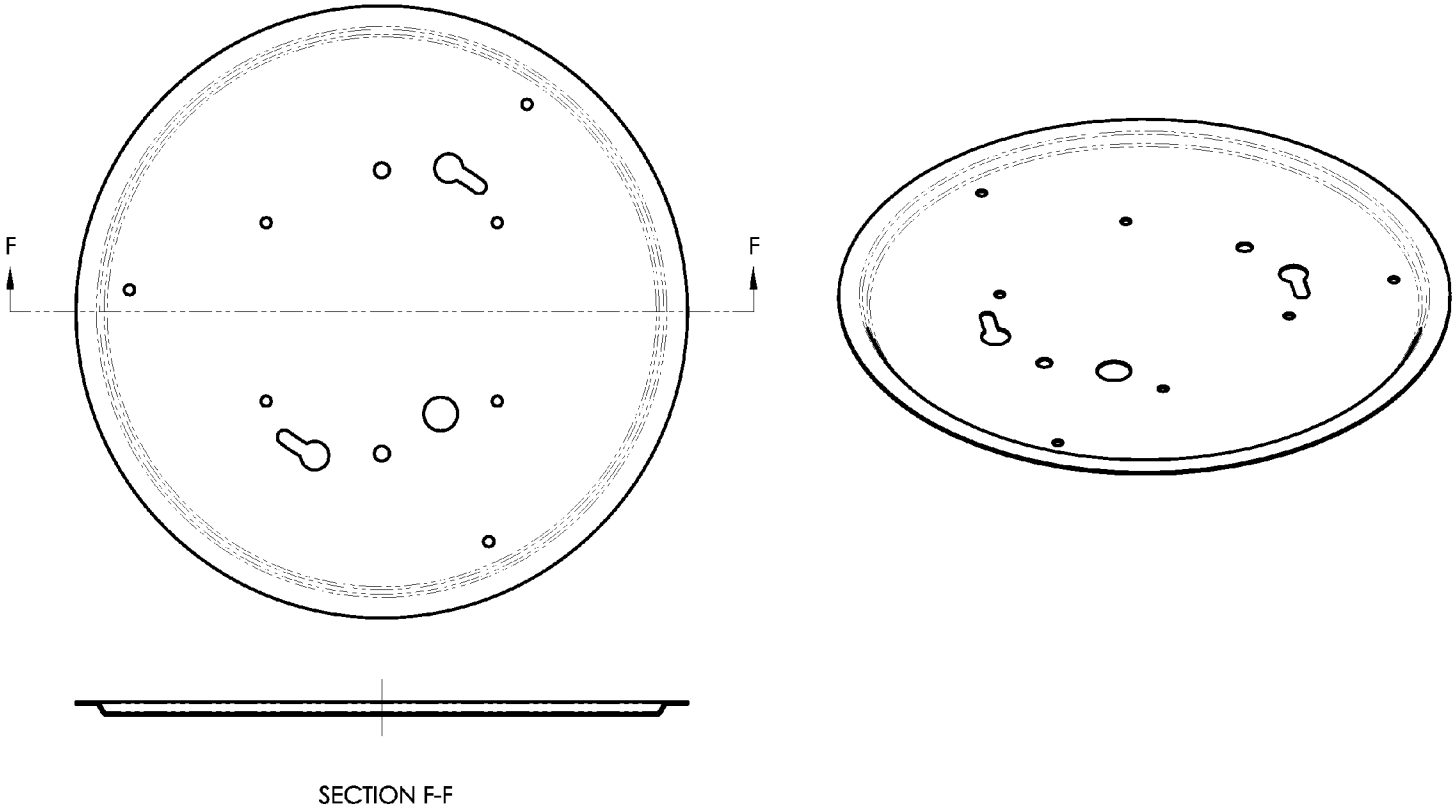
FIG. 7 shows the base plate supporting the PCB used in the embodiment from FIGS. 1-2.
Figure 8:
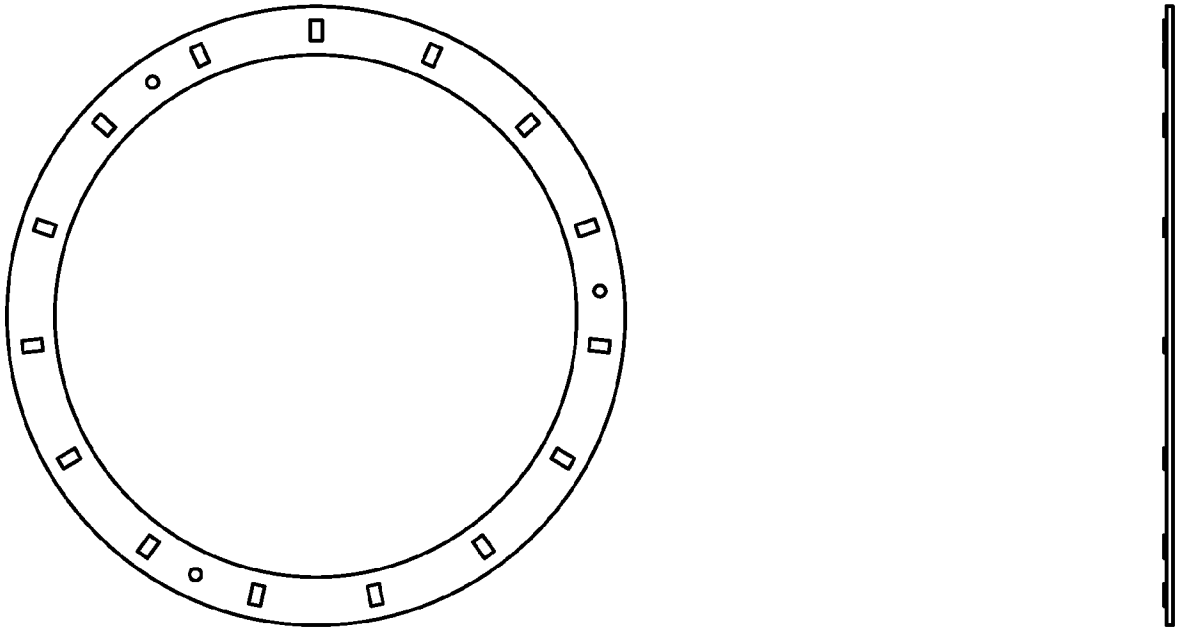
FIG. 8 shows the Printed Circuit Board (PCB) on which the ring of LEDs is mounted in the embodiment from FIGS. 1-2. Other LED arrangements and the number and size of LEDs used are contemplated.
Figure 9:
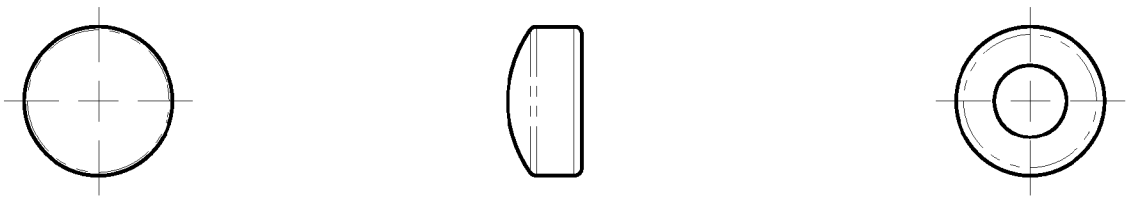
FIG. 9 shows a thumb nut used to hold the canopy assembly from FIGS. 1-2 together.

The embodiment in FIG. 1(*c*) and FIGS. 2(*a*) and (*b*) includes an LED driver 24, an internal support bracket 26, a mounting plate 28, an LED printed circuit board 22, LEDs 34, a light reflector 32, and the canopy 18. A light transmission lens 30 is incorporated into the canopy 18 for distribution of the LED light from the general light source. The walls of the canopy 18 may be sloped as shown to project light downward into the room. A support 36 for the directional light source 12 is shown, suspending the directional light source 12 below.

FIGS. 2(*a*) and (*b*) are exploded views of the embodiment from FIG. 1, and show the preferred embodiment light reflector 32 is situated proximate to and at the center of a ring of LEDs 34. The lens 30 surrounds the LEDs 34 and the canopy is at the base 18. A bracket 26 is used to hold the internal components together, while a mounting plate 28 attaches to the ceiling structure or preferably the electrical junction box (not shown).

Other embodiments show a similar design but the light bar 14 is serpentine or straight shaped. The light bar may be rigid or may be bendable so its shape may be changed by the interior designer, electrician, or homeowner for customization. The shape of the light bar is optional, and is not critical to maintaining the performance of this concept.

Further, in FIG. 1(*c*), in alternative embodiments, the canopy 18 may include a transmitter/receiver module 38 wired to the printed circuit board 22 or the power source. The transmitter/receiver module 38 enables remote control of the light fixture. Electronics for such wireless remote controls are well known in the art as a means for wirelessly controlling the light fixture, such as from a smartphone or remote control, especially for controlling ceiling fans, for example. The receiving/sending module 38 may transmit a signal for Near Field Communication (NFC) to transfer information between devices when they are in contact.

Taking the same basic concept, a flexible track system could be mounted below the flush mount power canopy. The track can be positioned in multiple positions below the canopy, including off center.

A flexible or fixed, track light fixture, surface mounted to a ceiling can now be extended from just a power delivery system for track heads to a flush mount area light, with light being distributed from both sides. A standard track may also benefit by converting the standard power canopy into a flush mount fixture for ambient lighting. This could be located at the end of a track or between two track sections. For those applications which require a track to be mounted off center from the power feed (floating canopy), the canopy can be transformed into a flush mount fixture still allowing maximum space for the heads. These embodiments are shown, for example, in the attached drawing FIGS. 11, 13.

One beneficial element of the present invention is the conversion of the canopy for power connections to be converted into an LED flush mount fixture, and in the case of the flush mounted track light, the conversion of a buss bar system into a flush mount fixture with provisions for track heads.

The end user benefits include improved lighting for tasks and ambient, lower power consumption, dual switching of the two light sources to save power (if wired correctly), and the convenience of using only one junction box for the application in a small package.

Specifically, the present invention in the preferred embodiments includes at least two major improvements over the state-of-the-art products: (1) The first such embodiment is converting the power canopy from a light bar or track type fixture into a flush mount fixture with an integral power canopy. The state of the art with respect to incandescent, directional and non-directional lighting, features adjustable heads with a flush mount fixture, would be replaced by the preferred embodiments.

FIGS. 1-9 depict preferred embodiment directional and non-directional lighting in combination, and features adjustable heads with a flush mount fixture. The preferred embodiment incorporates directional, adjustable lighting assembly/assemblies and an LED flush mount fixture, non-directional lighting, with a wiring/driver a compartment for both luminaires. This arrangement is unique in size, heat, and light distribution.

Conventional flush mount fixtures have the driver inside the fixture, but there is no additional wiring provided for additional fixture types. The flush mount is also optimized to uniformly light the diffuser through LED spacing. Such a fixture typically mounts flush with the ceiling, and may include LEDs as the light source.

On the other hand, the preferred embodiments of the present invention shown in, for example, FIGS. 1, 2, have an internal reflector to uniformly illuminate the lens, since the center section is used for power connections and the LED drivers. A further feature is the optional elimination of the plated/painted ring around the edge of the fixture. This type of separation between the illuminated lamp compartment and ceiling is no longer warranted as with conventional flush mount fixtures, because temperatures in the present invention fixture have been dropped to much lower levels. This allows the lens to be flush mounted against the ceiling without the issue of the ceiling becoming too hot for UL requirements.

There are many variations on this theme, but the concept is still the same in a preferred embodiment as seen in, e.g., drawing FIGS. 1-2: a flush/surface mounted canopy/enclosure system, a stem or nipple to carry power below the fixture, with an LED assembly providing non-directional general light and additional fixtures provided below the canopy/enclosure for directional illumination. The directional illumination may use LEDs, halogen, fluorescent, incandescent, neon, etc. The assembly also includes mounting so that the system may be mounted to a surface. The present invention is not limited to the shape of the diffuser/canopy/enclosure or directional heads provided below or the mounting of the heads which mount below, as depicted in the drawings.

(2) The second embodiment of the present invention converts an existing track system into a flush mount fixture with a buss bar system.

This flush mount with track bar embodiment, as seen below and in drawing FIGS. 10-17, includes a "track" which is a buss bar system to adjustably mount a fixture anywhere along the length of the buss bar. The outer enclosure of the track is preferably only for enclosing the buss bars of the track system.

This embodiment changes the "track" into a surface/flush mount system that consists of at least one linear array of LEDs located adjacent to the buss bar system as an integral part of the buss bar enclosure. The linear array of directional track lights can be located on both sides or on either side of the opening for the buss bar connections. The preferred embodiment of the present invention can be assembled as a multiple part system, LED mounting as a separate plate, or made with the LED mounting integral to the buss bar enclosure. In the embodiment shown in FIG. 11, both sides of the track have LED arrays which are powered from the same canopy, but the arrays have a separate driver for their power, and the track may or may not have a power supply depending on the voltage required.

Figure 10:
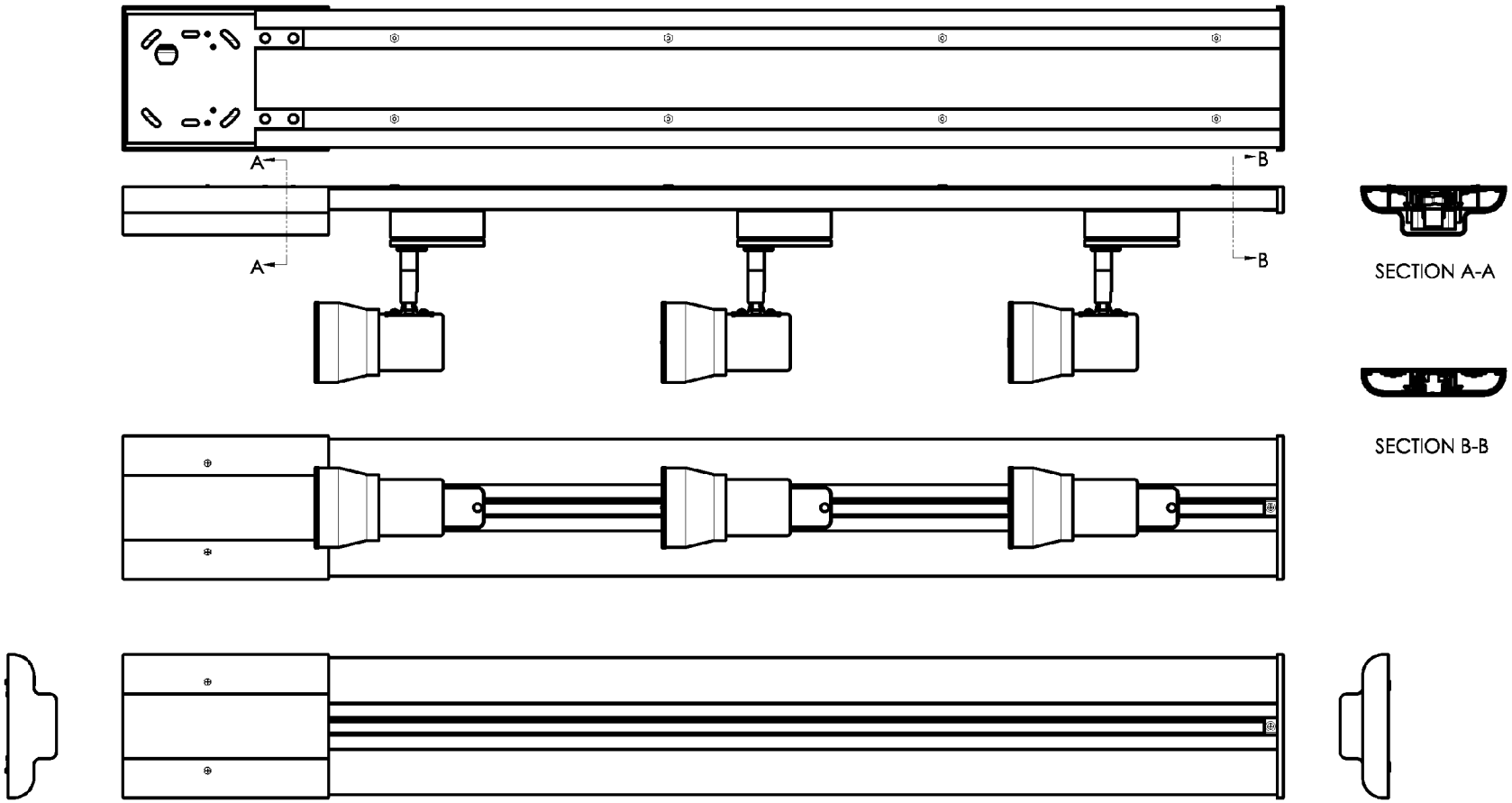
FIGS. 10-11 show in various views a second embodiment LED track light with the LED electrical hardware encased in a canopy and the track extending from one side of the canopy. The general light source inside the canopy is optionally omitted from this embodiment.
Figure 11:
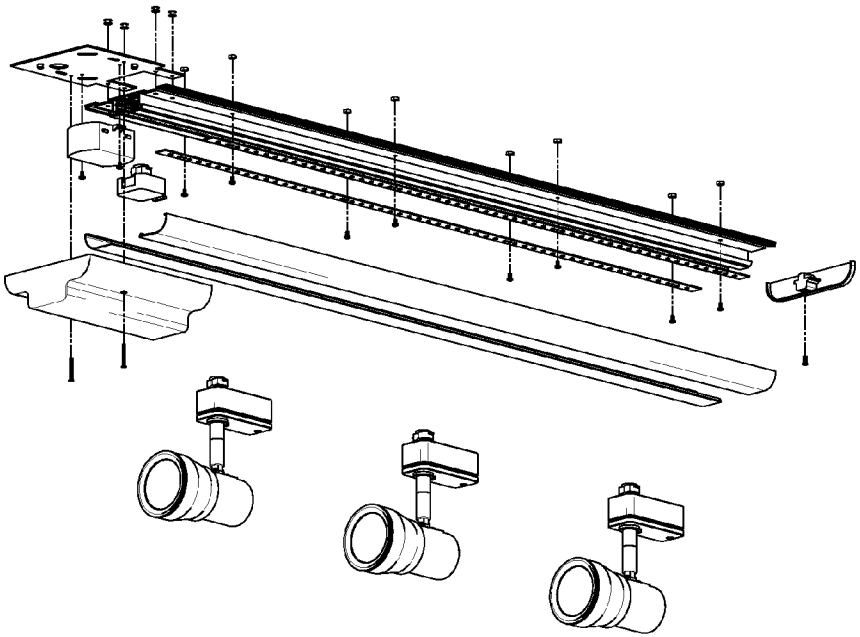
Figure 11:
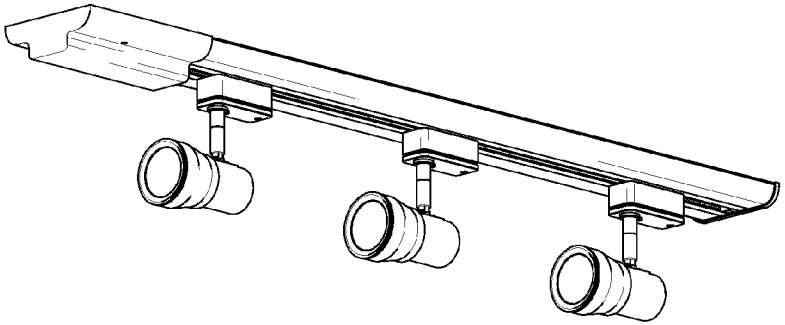
Figure 12:
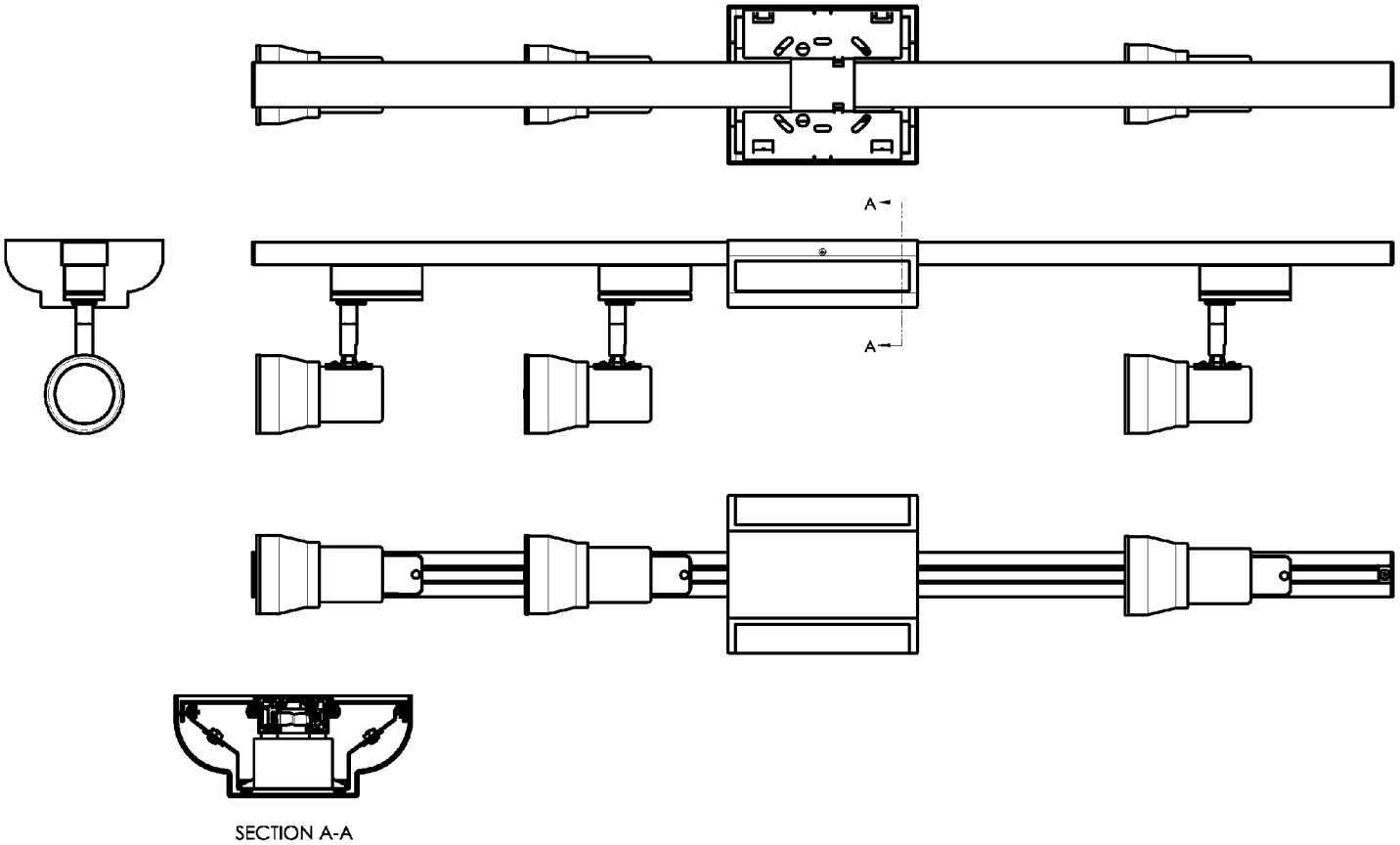
FIGS. 12-13 show in various views a third embodiment LED track light where the track bar is slidable through the LED lighted canopy. The LED driver is preferably mounted inside the canopy, while the LEDs are outside the canopy but covered by a lens.
Figure 13:
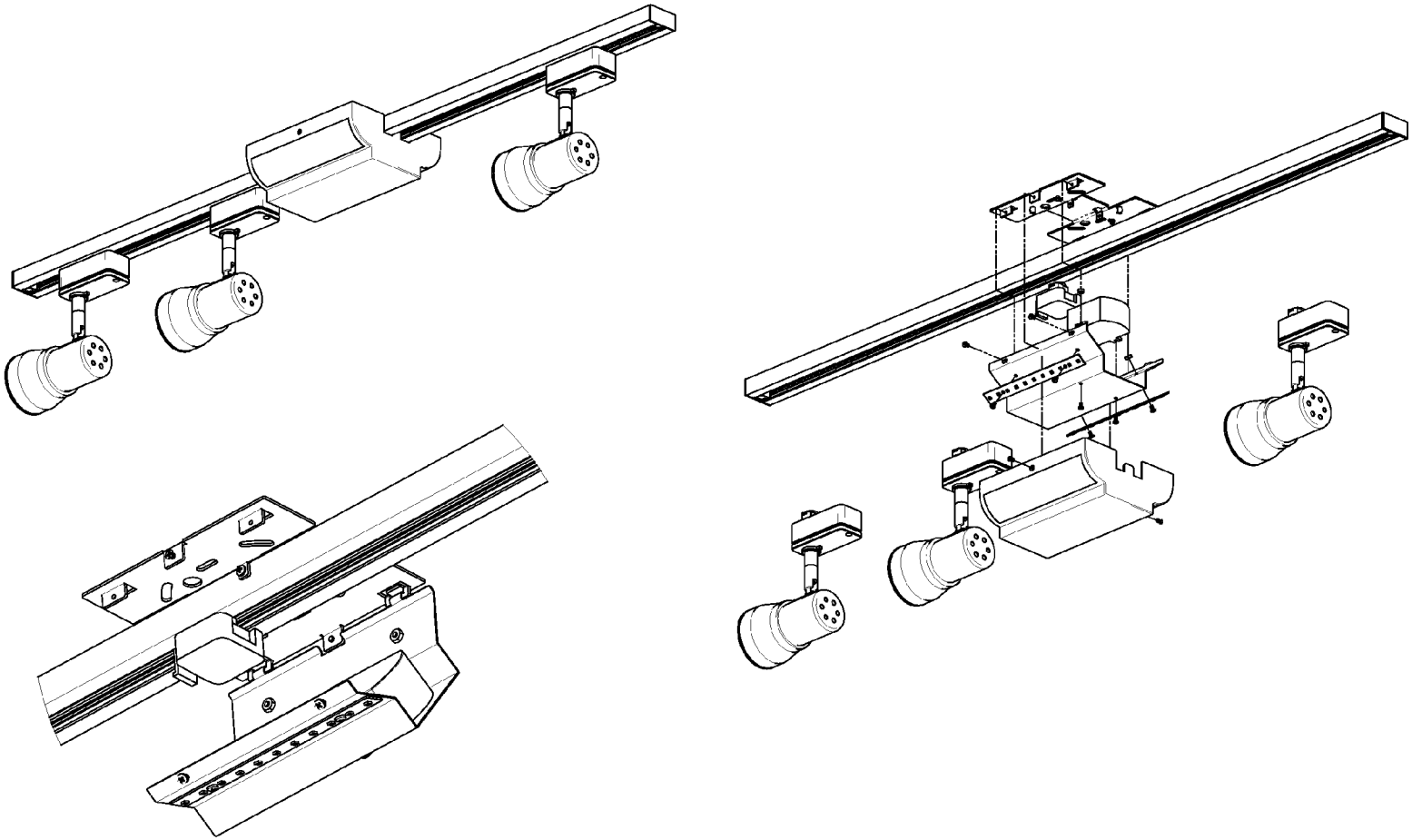
Figure 14:
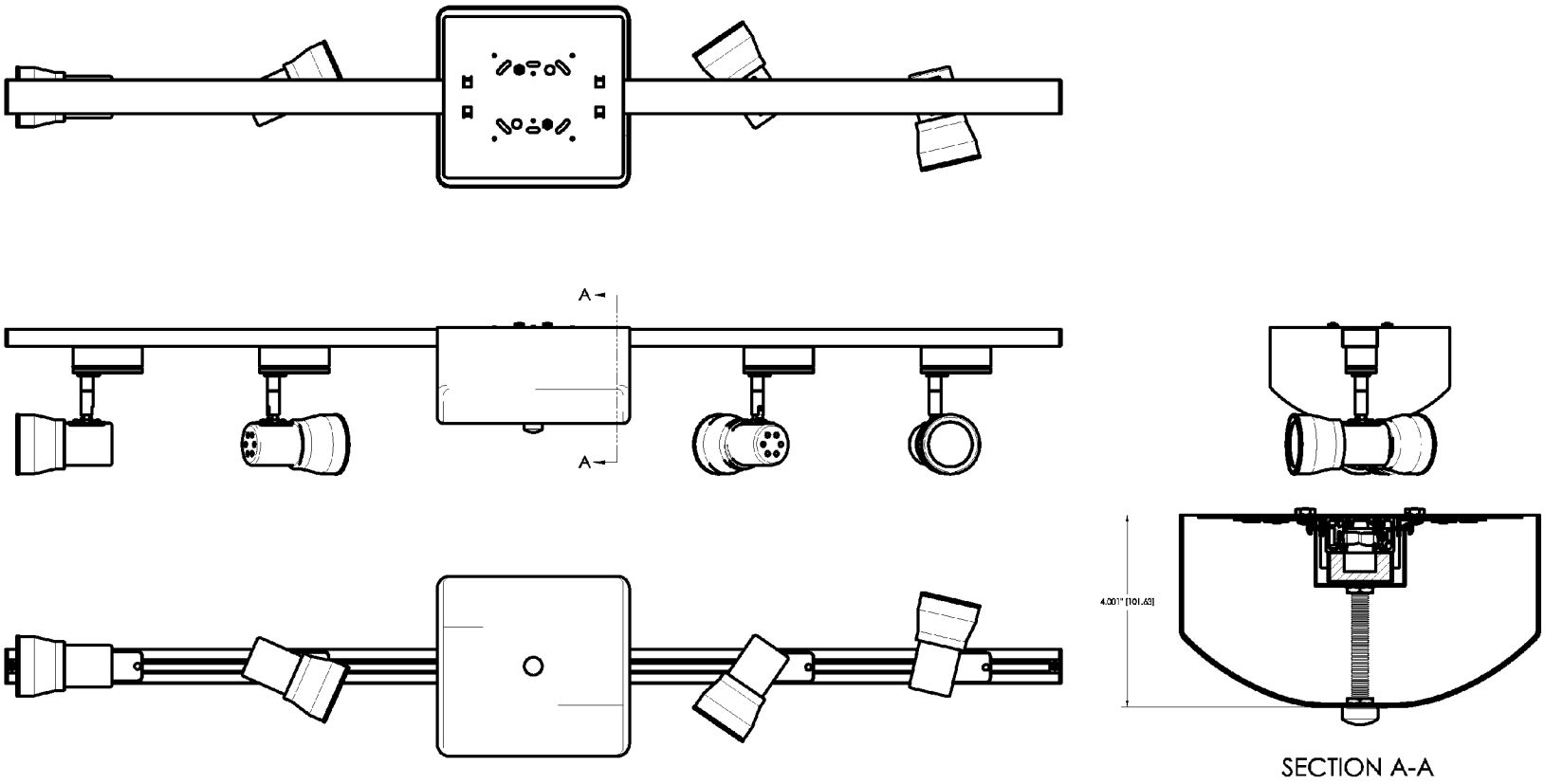
FIGS. 14-15 show in various views a fourth embodiment LED track light where the track extends from different ends of the canopy, the LEDs are located inside the canopy and covered by a diffuser or lens type housing. It is contemplated (not shown) that the tracks may form an "L" shape with the canopy. Still other arrangements of the tracks are contemplated such as a crisscross, or spokes on a wheel, etc.
Figure 15:
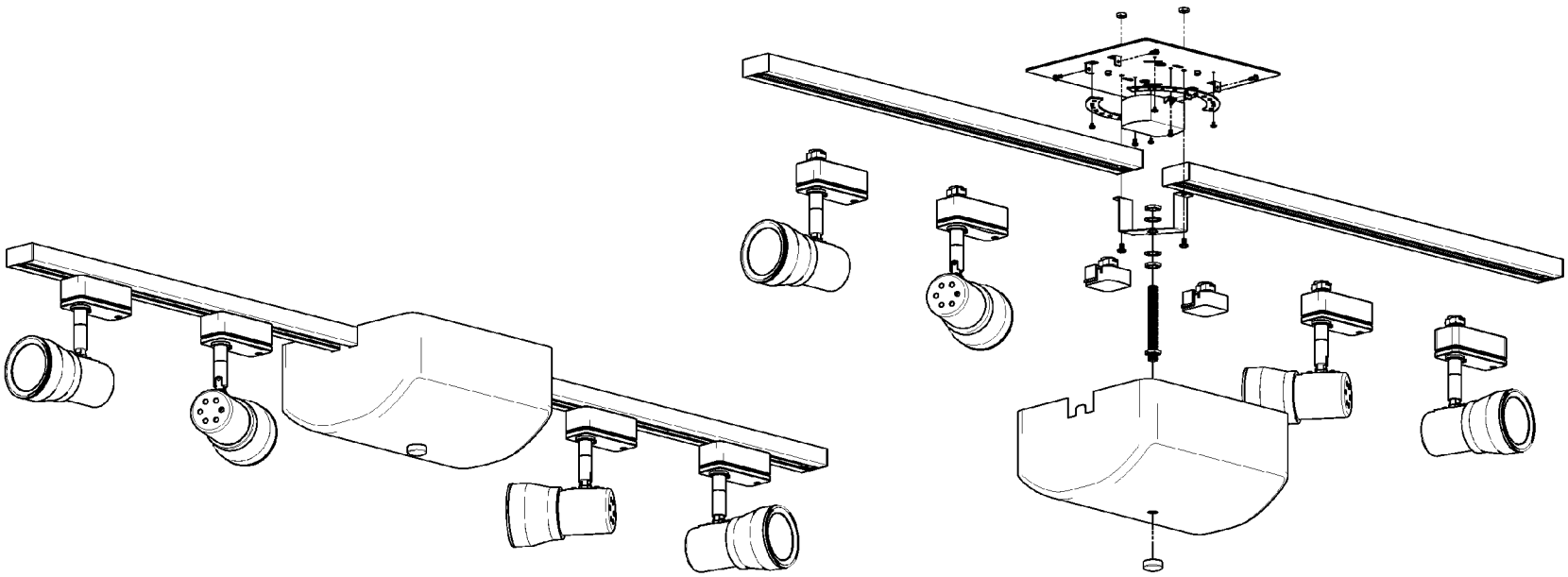
Figure 16:
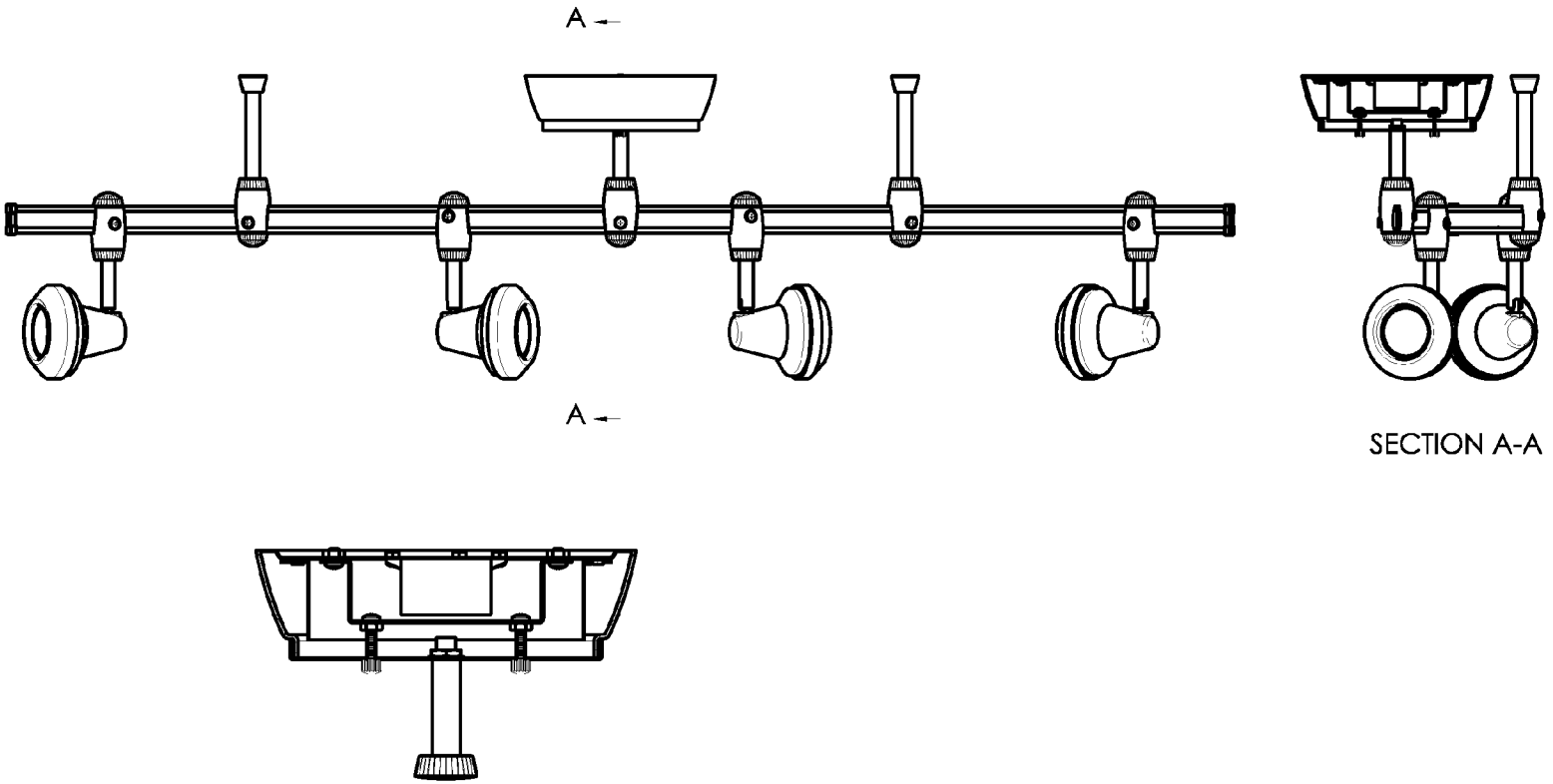
Figure 18:
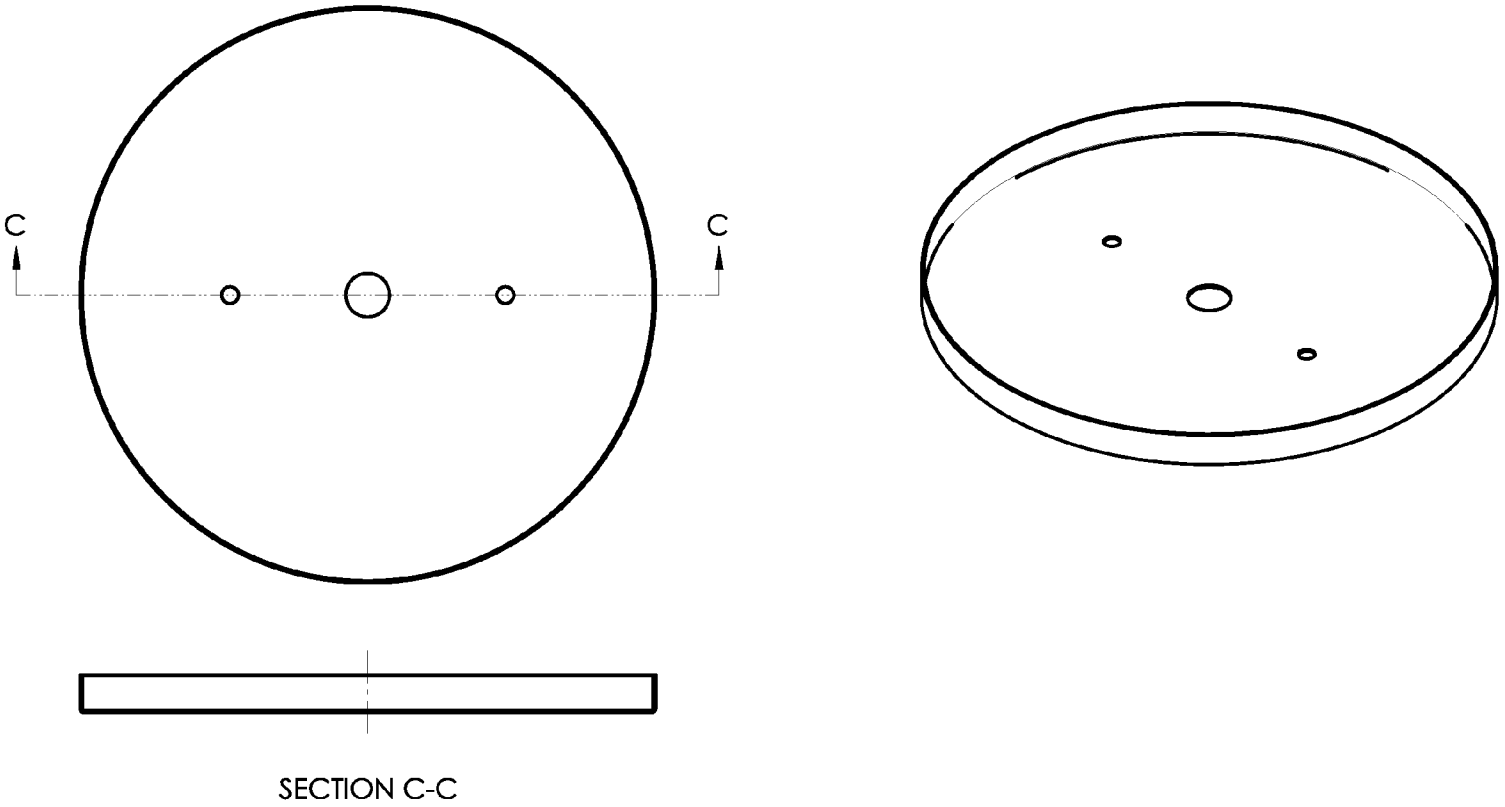
FIG. 18 contains different views of the canopy used in the embodiment from FIGS. 16-17. It is preferably made from plastic, metal, ceramic, glass, and may be translucent or may be opaque.
Figure 19:
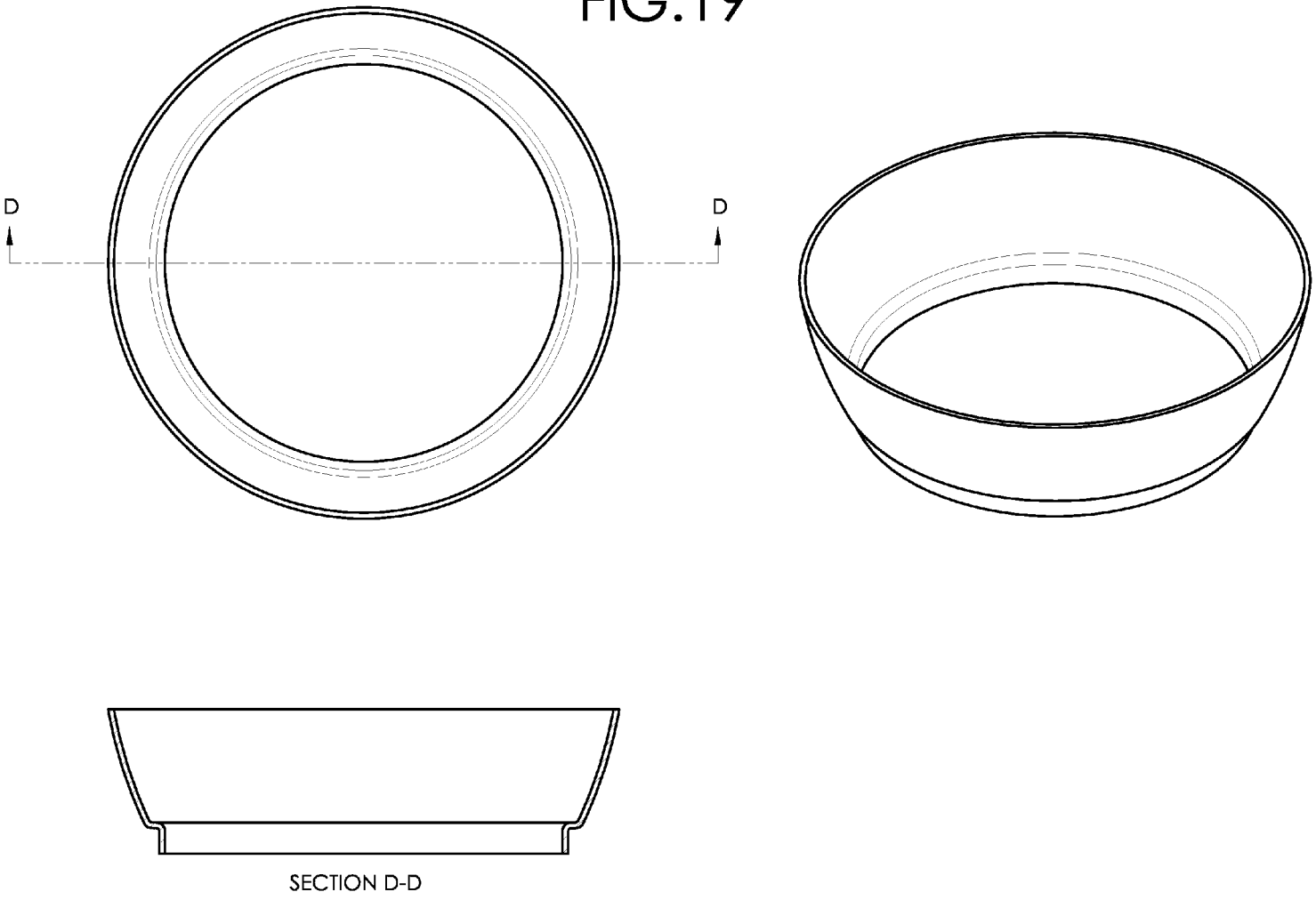
FIG. 19 contains different views of the lens used in the embodiment from FIGS. 16-17.
Figure 20:
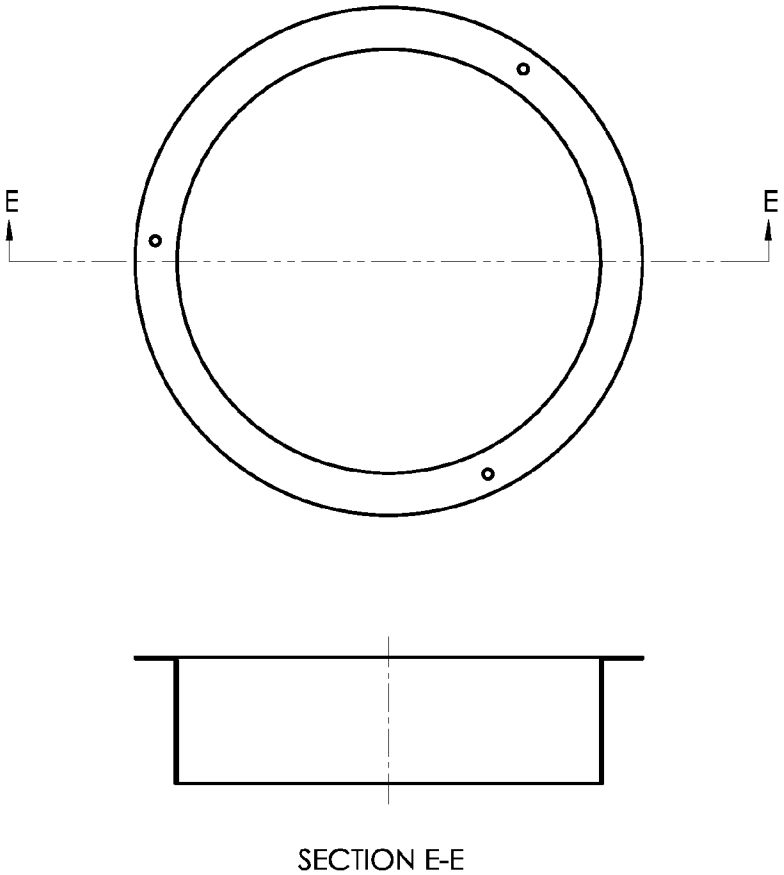
FIG. 20 contains different views of the reflector used in the embodiment from FIGS. 16-17.
Figure 21:
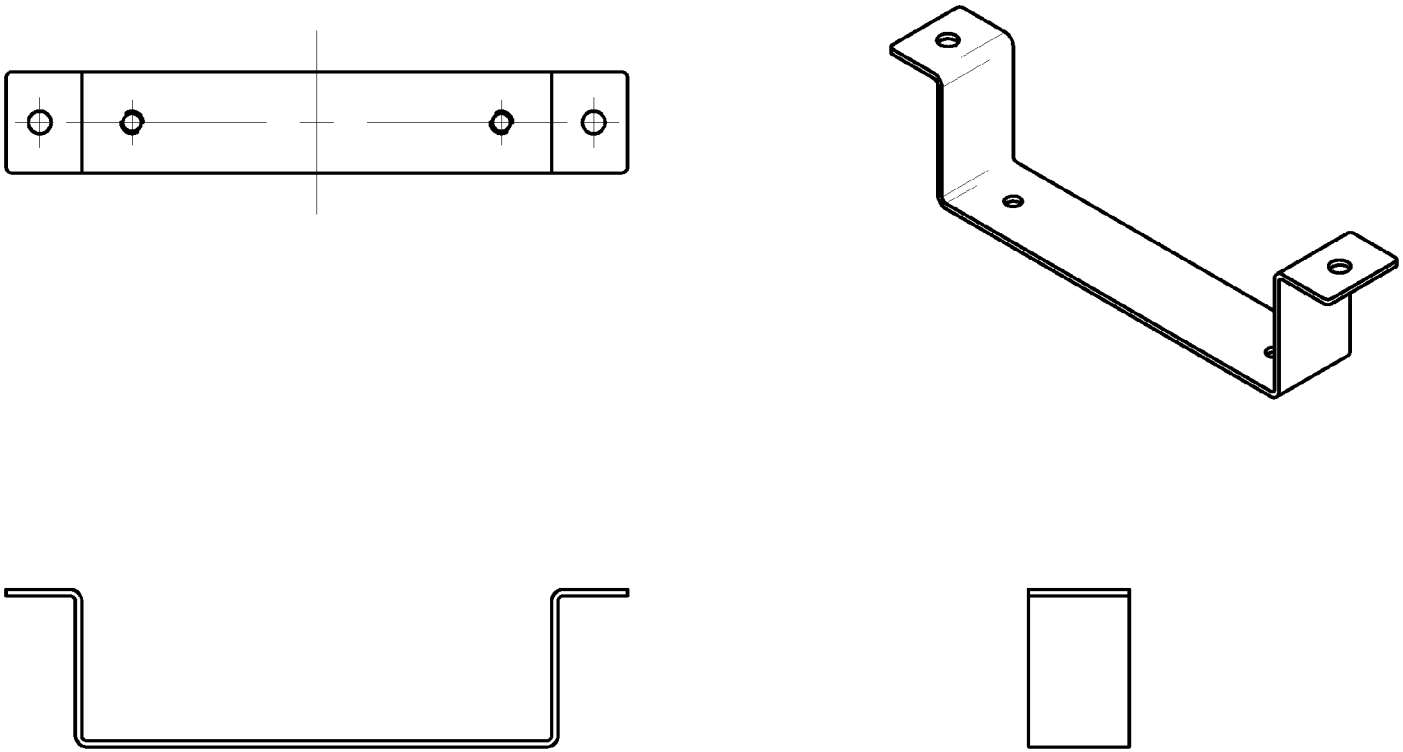
FIG. 21 contains different views of the hardware support bracket used in the embodiment from FIGS. 16-17.
Figure 22:
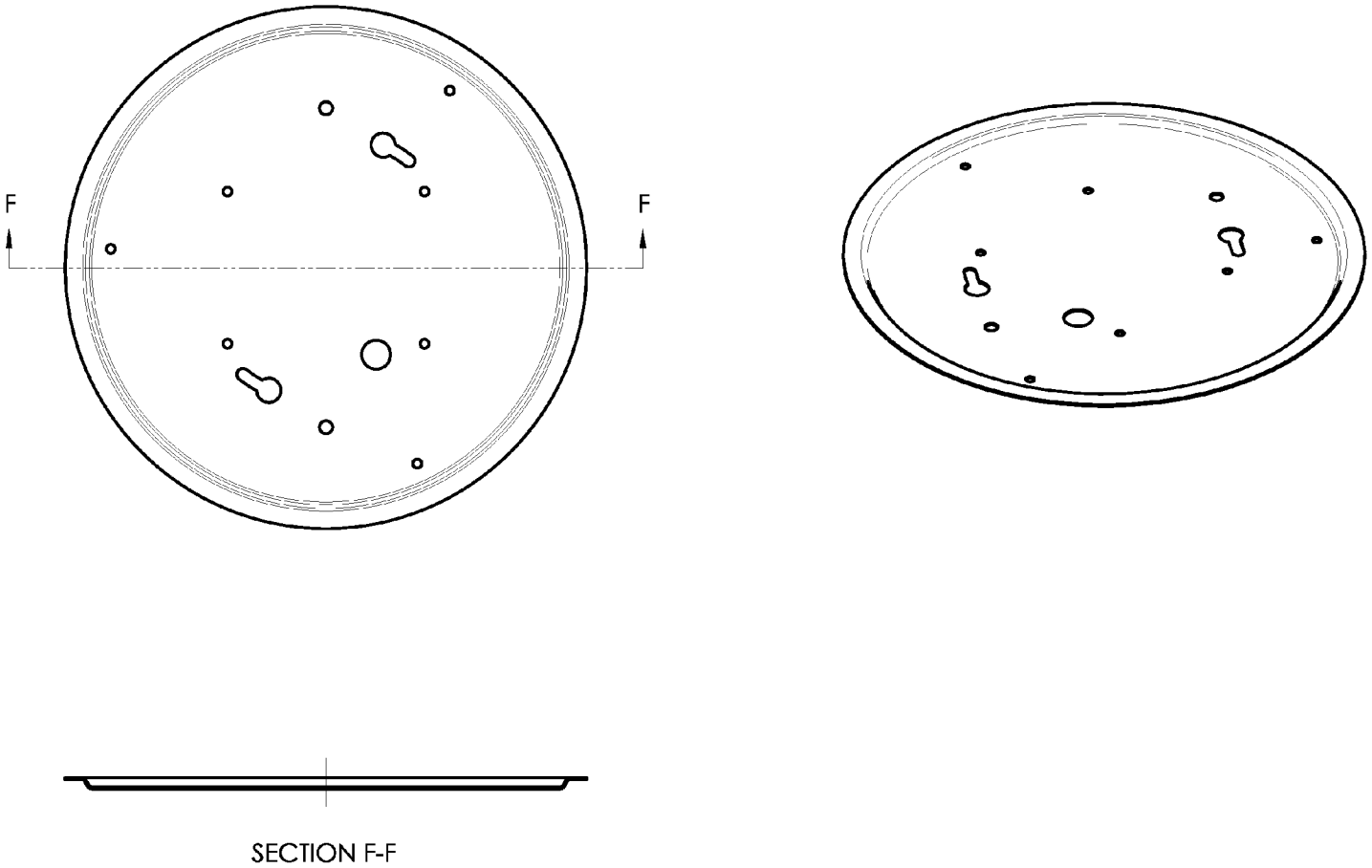
FIG. 22 contains different views of the base plate used in the embodiment from FIGS. 16-17.
Figure 23:
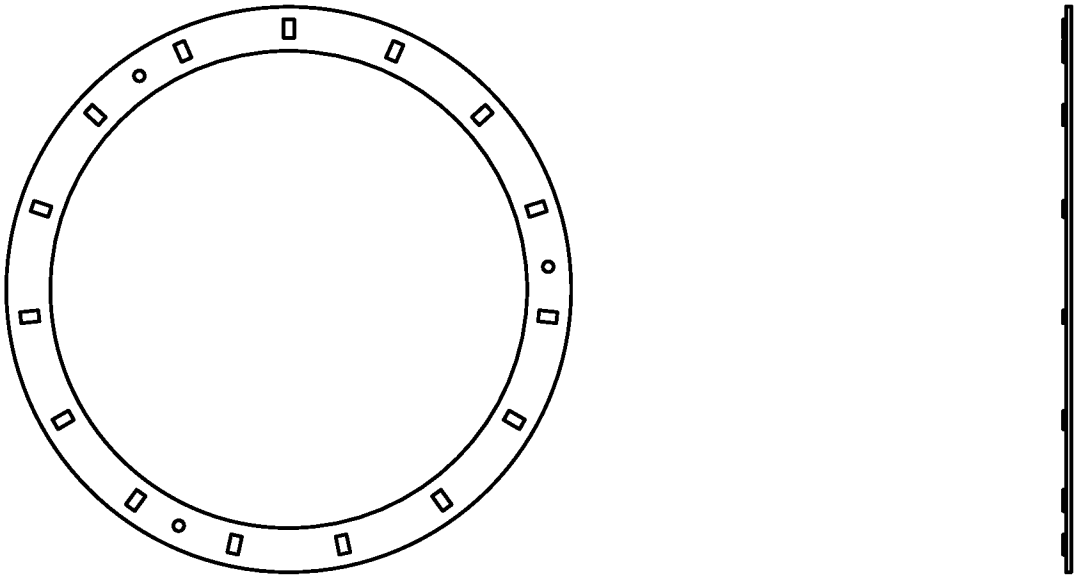
FIG. 23 contains different views of the PCB supporting an array of LEDs and mounted to the base plate as seen in the embodiment from FIGS. 16-17.

The FIG. 11 embodiment also carries forward some of the features from the previous embodiments. Specifically, the power canopy serves as a light fixture and a power canopy. FIGS. 10, 11 embodiments are a track system with one or more track sections with power coming from the end of the track, and the LED driver is mounted to the ceiling side of the canopy, rather than the room side of the canopy, but still inside the canopy. Further alternative embodiments of this power canopy, e.g., FIGS. 12-17, can be located directly over the track and connected internally to the track to power the LED driver contained within the canopy.

Still further embodiments can also include LED canopy types with electrical terminations specific to different track systems, such as an RCA type termination or a twist and lock type adapter from a standard track head. The specific terminations would replace the stem/pipe of the first embodiment to provide power to a track or pendant type fixture connected to this assembly. The assembly can be round or linear.

The preferred embodiment includes a buss bar or similar power delivery system, flexible or fixed, capable of accepting at least one "track" head, at least one LED array, a power enclosure at least partially covered by the diffuser of the LED array and assembled in a manner to make the LED array and power enclosure as one unit when installed, the assembly also may include mounting hardware capable of installing the assembly onto a ceiling or walled surface.

The uniqueness of the preferred embodiments addresses the issue of limited access to power, the need for multiple fixture types with limited access to power, and the need for these to be combined into a fixture size that could be used in all ceiling heights.

While particular forms of the invention have been illustrated and described, it will be apparent that various modifications can be made without departing from the spirit and scope of the invention. It is contemplated that components from one embodiment may be combined with components from another embodiment.

What is claimed is:

1. A lighting system electrically wired to a power source, comprising:

a general light source further including:

a LED driver;

a printed circuit board with at least one LED mounted thereon;

at least one electrical connector;

a canopy at least partially covering the LED driver, printed circuit board, the at least one electrical connector, and the at least one LED, wherein the canopy includes a light transmitting lens;

wherein the LED driver, printed circuit board, and the at least one electrical connector are electrically wired to the power source;

a directional light source extending from the general light source, further including:

a light bar disposed on the general light source;

at least one secondary light source;

a housing at least partially enclosing the secondary light source and having a position on the light bar and aimed in a direction, wherein at least one of position and direction of the housing is adjustable relative to the light bar; and electrical conductors disposed at least one of on and within the light bar, electrically connecting the secondary light source to the electrical connector of the general light source.

2. The lighting system of claim 1, wherein the general light source and the directional light source are contained in a common plane.

3. The lighting system of claim 1, wherein the at least one electrical connector includes a quick connect electrically wired to the LED driver, and the at least one secondary light source includes an LED electrically wired to the quick connect.

4. The lighting system of claim 1, wherein the electrical connector includes a quick connect electrically wired to the LED driver, and the directional light source includes a plurality of housings with respective LEDs disposed on the light bar.

5. The lighting system of claim 3, wherein the LEDs of the general light source and the directional light source include at least one of parallel and series wiring.

6. The lighting system of claim 1, wherein the general light source includes a wireless control interface.

7. The lighting system of claim 1, wherein the general light source includes one interface for Near Field Communication (NFC).

8. The lighting system of claim 1, wherein the general light source is located at an end of the light bar of the directional light source.

9. The lighting system of claim 1, wherein opposite ends of the light bar of the directional light source extends from opposite sides of the general light source.

10. The lighting system of claim 1, wherein the canopy includes a light reflector disposed proximate to the at least one LED.

11. A lighting system electrically wired to a junction box, comprising:

a general light source having a distribution of light greater than about 300 degrees about a vertical axis and greater than 65 degrees from nadir off of the vertical axis, the general light source further including:

a LED driver;

a printed circuit board with an array of LEDs mounted thereon;

a reflector disposed at about a center of the array of LEDs;

an electrical connector;

a canopy at least partially covering the LED driver, printed circuit board, array of LEDs, electrical connector, reflector, wherein the canopy includes a light transmitting lens;

wherein the LED driver, printed circuit board, and electrical connector are electrically wired to the junction box;

a directional light source extending from the general light source, further including:

a light bar disposed on the general light source;

at least one secondary light source;

a housing at least partially enclosing the secondary light source and having a position on the light bar and aimed in a direction, wherein at least one of position and direction of the housing is adjustable relative to the light bar;

electrical conductors disposed on the light bar, electrically connecting the secondary light source to the electrical connector of the general light source; and a mounting system supporting the general and directional light sources and disposed on the junction box.

12. The lighting system of claim 11, wherein the electrical connector includes a quick connect electrically wired to the LED driver, and the directional light source includes a plurality of housings with respective LEDs disposed on the light bar, wherein the LEDs are electrically wired to the quick connect.

13. The lighting system of claim 11, wherein the at least one secondary light source includes at least one of an incandescent bulb, a halogen bulb, a LED bulb, a LED die, a LED array, a neon bulb, a CFL, and a fluorescent tube.

14. The lighting system of claim 11, wherein the general light source and the directional light source are contained generally in a common elevation plane.

15. A lighting system electrically wired to a junction box, comprising:

a general light source further including:

a LED driver;

a printed circuit board with at least one LED mounted thereto;

at least one electrical connector;

a light reflector disposed proximate the at least one LED;

a canopy at least partially covering the LED driver, printed circuit board, the at least one electrical connector, the light reflector, and the at least one LED, wherein the canopy includes a light transmitting lens;

wherein the LED driver, printed circuit board, and the at least one electrical connector are electrically wired to the junction box;

a directional light source extending from the general light source, further including:

an elongated light bar connected to the general light source;

at least one secondary light source;

a housing at least partially enclosing the secondary light source and having a position on the light bar and aimed in a direction, wherein at least one of position and direction of the housing is adjustable relative to the light bar; and electrical conductors disposed at least one of on and within the light bar, electrically connecting the secondary light source to the electrical connector of the general light source.

16. The lighting system of claim 15, wherein the LEDs are arranged in a row and the canopy includes a rectangular shape.

17. The lighting system of claim 15, wherein the light bar is slidable relative to the canopy.

18. The lighting system of claim 15, wherein the electrical conductors of the directional light source include tracks extending along a length of the light bar.

* * * * *